United States Patent [19]

Luke et al.

[11] Patent Number: 5,072,744

[45] Date of Patent: Dec. 17, 1991

[54] RELATING TO THE MAKING OF SMOKING ARTICLES

[75] Inventors: John A. Luke, Eastleigh; Paul D. Case, Southampton; Stephen R. Hemsley, Romsey, all of England

[73] Assignee: British-American Tobacco Company Limited, London, England

[21] Appl. No.: 533,382

[22] Filed: Jun. 5, 1990

[30] Foreign Application Priority Data

Jun. 23, 1989 [GB] United Kingdom ..... 8914508

[51] Int. Cl.[5] ..... A24B 15/12

[52] U.S. Cl. ..... 131/375; 131/77; 131/78

[58] Field of Search ..... 131/77, 78, 375

[56] References Cited

U.S. PATENT DOCUMENTS

| | | | |
|---|---|---|---|
| 3,098,492 | 7/1963 | Wurzburg et al. . | |
| 3,223,090 | 12/1965 | Strubel et al. . | |
| 3,968,804 | 7/1976 | Kelly et al. . | |
| 4,632,131 | 12/1986 | Burnett et al. | 131/77 |
| 4,880,018 | 11/1989 | Graves, Jr. et al. | 131/375 |

FOREIGN PATENT DOCUMENTS

| | | |
|---|---|---|
| 951209 | 7/1974 | Canada . |
| 0113595 | 12/1983 | European Pat. Off. . |
| 0167370 | 6/1985 | European Pat. Off. . |
| 0248128 | 6/1986 | European Pat. Off. . |
| 275420 | 8/1951 | Switzerland . |
| 5367 | of 1898 | United Kingdom . |
| 1055445 | 9/1963 | United Kingdom . |
| 1234786 | 2/1968 | United Kingdom . |
| 2078087 | 5/1981 | United Kingdom . |
| 2201080A | 2/1988 | United Kingdom . |
| 2201081A | 2/1988 | United Kingdom . |

*Primary Examiner*—V. Millin
*Assistant Examiner*—Lynne A. Reichard
*Attorney, Agent, or Firm*—Kane, Dalsimer, Sullivan, Kurucz, Levy, Eisele, Richard

[57] ABSTRACT

Smoking article rod is made by extruding a tobacco/-binder mixture, with the addition of water, to provide a rod form extrudate, under conditions such that the extrudate is of a cross-section greater than that of the die orifice. The extrudate is drawn down by, for example, passing the extrudate about two driven and peripherally grooved draw down drums.

10 Claims, 2 Drawing Sheets

RELATING TO THE MAKING OF SMOKING ARTICLES

The invention which is the subject of this application relates to the making of a tobacco-containing smoking article rod.

In the operation of a conventional cigarette rod making machine, such for example as a Molins Mk. 10, cut tobacco is fed continuously, in the form of a narrow carpet, to an entry end of a so-called garniture unit. Also fed to the entry end of the garniture unit is a continuous web of paper wrapper. During the passage of the tobacco and the wrapper web through the garniture unit, the wrapper web is first caused to be wrapped about the tobacco and is then lap seamed. There thus issues continuously from the outlet of the garniture unit a cigarette rod, usually of circular cross-section, comprised of cut tobacco within a paper wrapper.

Over a long period of time there have appeared in the patent literature proposals for the making of smoking article rods comprising small particles of tobacco which are bound together so as to provide a self-sustaining structure. In general terms, the patent specifications involved teach the extrusion or moulding of a composition comprising particulate tobacco and, usually, a binder. Examples of such specifications are:

CA 951209
CH 275420
EP 113595; 167370 and 248128
GB 5367/1898; 1055445; 1234786 and 2078087
U.S. Pat. No. 3098492; 3968804 and 3223090

Notwithstanding the prior proposals for making smoking article rods by use of moulding or extrusion technology, none of these proposals has found commercial acceptance. In order to be commercially acceptable a smoking article rod must meet criteria appertaining to smoulder, burning, ash formation, smoke taste and pressure drop. Thus, for example, the pressure drop of a rod must be accurately controlled and must generally lie within upper and lower limits of consumer acceptability. These limits being generally accepted to be about 115 mm WG and 80 mm WG, as measured on an unbound basis under ISO standard conditions.

EP 113595 proposes the making by an extrusion process of a monolithic smoking article of cigarette dimensions. However, in EP 167370 there is an indication that smoking articles according to EP 113595 were found to suffer from pressure drops that were too high and/or difficult to control. The solution to this problem proposed in EP 167370 is the co-extrusion of a multiplicity of strands, which strands are adhered to one another.

It is an object of the present invention to provide a method of making a smoking article rod whereof, even when the smoking material of the rod is of monolithic form, the pressure drop is fully acceptable.

The subject invention provides a method of making a smoking article rod, wherein a mixture of particulate tobacco and binder, with the addition of water, is extruded, to provide a rod form extrudate, under such extrusion conditions that said extrudate assumes a cross-section greater than that of the exit orifice of the extruder die, and said extrudate in the plastic phase thereof is drawn down.

Advantageously, the drawn down extrudate is passed through a garniture unit operable to wrap the extrudate in a wrapper material, suitably a conventional cigarette paper.

Preferably, the cross-section of a smoking article rod thus wrapped is somewhat smaller than that of the rod form extrudate at entry thereof to the garniture unit. That is to say, it is preferable that in the passage thereof through the garniture unit, the extrudate is subjected to radial compression. The thus effected reduction in the cross-section of the extrudate is maintained in the resultant smoking article rod by the presence of the wrapper. Suitably, as is usual in the conventional method of forming tobacco rod in a cigarette rod making machine comprising a garniture unit, the wrapper is, during passage thereof through the garniture unit in accompaniment with the extrudate, lap seamed, to provide a wrapper which sustains the hoop stresses engendered by the radially outwardly directed resiliency forces of the compressed extrudate.

Advantageously, the draw down ratio is at least 1.5:1. More advantageously, the draw down ratio is at least 5:1 and yet more advantageously the draw down ratio is at least 10:1.

It has been observed of rod the product of the subject invention that the cellular structure thereof is of an axially elongate conformation. Such conformation results from the draw down to which the extrudate is subjected. It is this conformation that ensures that smoking article rods produced in accordance with the subject invention exhibits a fully acceptable pressure drop therealong.

A Molins cigarette rod making machine comprises a perforated, metal so-called suction band and associated suction means, the latter of which is operable to maintain a pressure drop across the lower run of the band. In conventional use of such rod making machine, cut tobacco adheres to the under side of the lower run of the suction band under the action of the suction means, thereby being built up on the band the aforesaid narrow carpet of tobacco. Movement of the lower run of the band feeds continuously the tobacco towards the entry end of the garniture unit of the rod making machine. An expedient in carrying out the subject inventive method is to utilize a suction band and suction means as a draw down device. Alternatively, a draw down drum is used. Preferably, two draw down drums are used.

In carrying out the subject inventive method the binder utilized suitably comprises a cellulosic binder. The preferred cellulosic binder materials for use in practising the subject invention are hydroxypropyl cellulose and carboxymethyl cellulose, the former being found to be especially effective. Other suitable cellulosic binder materials are hydroxyethyl cellulose, methyl cellulose and ethyl cellulose. Further suitable cellulosic binder materials will readily occur to those knowledgeable of prior proposed tobacco reconstitution processes. Binder of the tobacco/binder mixture may be provided by two or more binder materials, in which case it is advantageous that one of these materials is hydroxypropyl cellulose.

It is preferred that the materials fed to the extruder include starch, in which case the starch is suitably present in the tobacco/binder/starch mixture at a level within a range of 5% to 35% by weight, and more suitably within a range of 8% to 20% by weight. The starch is advantageously present in the mixture in an amount by weight exceeding that of binder by two times and more advantageously by three or more times.

Starch used in carrying out the subject invention may be, for example, maize or corn starch. The starch, or a proportion thereof, may be a modified starch.

The level of binder in tobacco/binder/starch mixtures utilized in carrying out the subject invention preferably does not exceed 10% by weight and more preferably does not exceed 5% by weight.

A sugar also may be fed to the extruder.

Advantageously, the total water present in the extruder is such that, without an extrudate drying step being utilized, the moisture content of the extrudate at exit from the garniture unit is within a range of 10% to 16% by weight (wet basis). By "total water" is meant the sum of any moisture present in the "dry" components fed to the extruder plus any added water. Water may be added to one or more of the components of the mixture before the components are fed to the extruder and/or by way of injection via a barrel port(s) of the extruder barrel. A convenient practice is to mix the components of the mixture and then to feed the mixture in a dry or substantially dry state to the extruder. Water is added by injection into the extruder barrel.

Suitably, a plasticizer, such for example as glycerol or propylene glycol, is fed to the extruder with the components of the above referred to mixture and/or by way of injection into the extruder barrel. The inclusion level of the plasticizer may be within a range of 1 to 10% by weight on a wet basis.

We have found that products with optimized characteristics are obtained by ensuring that the processing within the extruder of the materials fed thereto takes place adiabatically or close to adiabatically. It is also important to operate with an extruder barrel temperature profile up to the extruder die such that the temperature of the tobacco portion of the materials in the extruder does not attain a value which would be deleterious to the tobacco and is suitably in a range of 80° C. to 180° C.

That is not to say that processing conditions may not be adopted which result in a degree of "toasting" of the tobacco portion. Such treatment of the tobacco portion could produce desirable flavour effects.

The processing advantageously takes place under such conditions that immediately upon it issuing from the die, the extrudate is expanded by water therein flashing off to steam. There is thereby effected an increase in the cross-section of the extrudate and the establishment of a cellular interior structure. The density of the extrudate may be in a range of 50 mg/cc to 500 mg/cc, and preferably not more than 300 mg/cc.

A gaseous expansion agent may also be used.

As will be readily appreciated by those skilled in the tobacco reconstitution art, possibilities arise for feeding flavorant materials to the extruder. Such materials may be nature-identical or artificial flavorants or botanical extracts. Such materials may be insoluble materials.

Rod form extrudate provided in accordance with the present invention may comprise two co-extruded, co-adhered, sub-extrudates. The sub-extrudates may be in side-by-side relationship or one of the sub-extrudates may circumscribe the other.

Lengths of rod form extrudate provided in accordance with the present invention may be subjected to a thermal molding process in order to impart a desired configuration thereto. The thermal molding process may be generally as disclosed in United Kingdom Patent Specification No. 1,507,765, notwithstanding the fact that as disclosed in that specification the process relates to the shaping of filter rod lengths.

Smoking article rod made in accordance with the subject inventive method may be interattached to filter elements.

The particulate tobacco used in the subject inventive process can be derived from the stem and/or the lamina portions of tobacco leaf and could be factory waste tobacco dust.

In order that the present invention may be clearly understood and readily carried into effect, reference will now be made, by way of example, to the schematic drawings hereof, in which.

Figure 1:
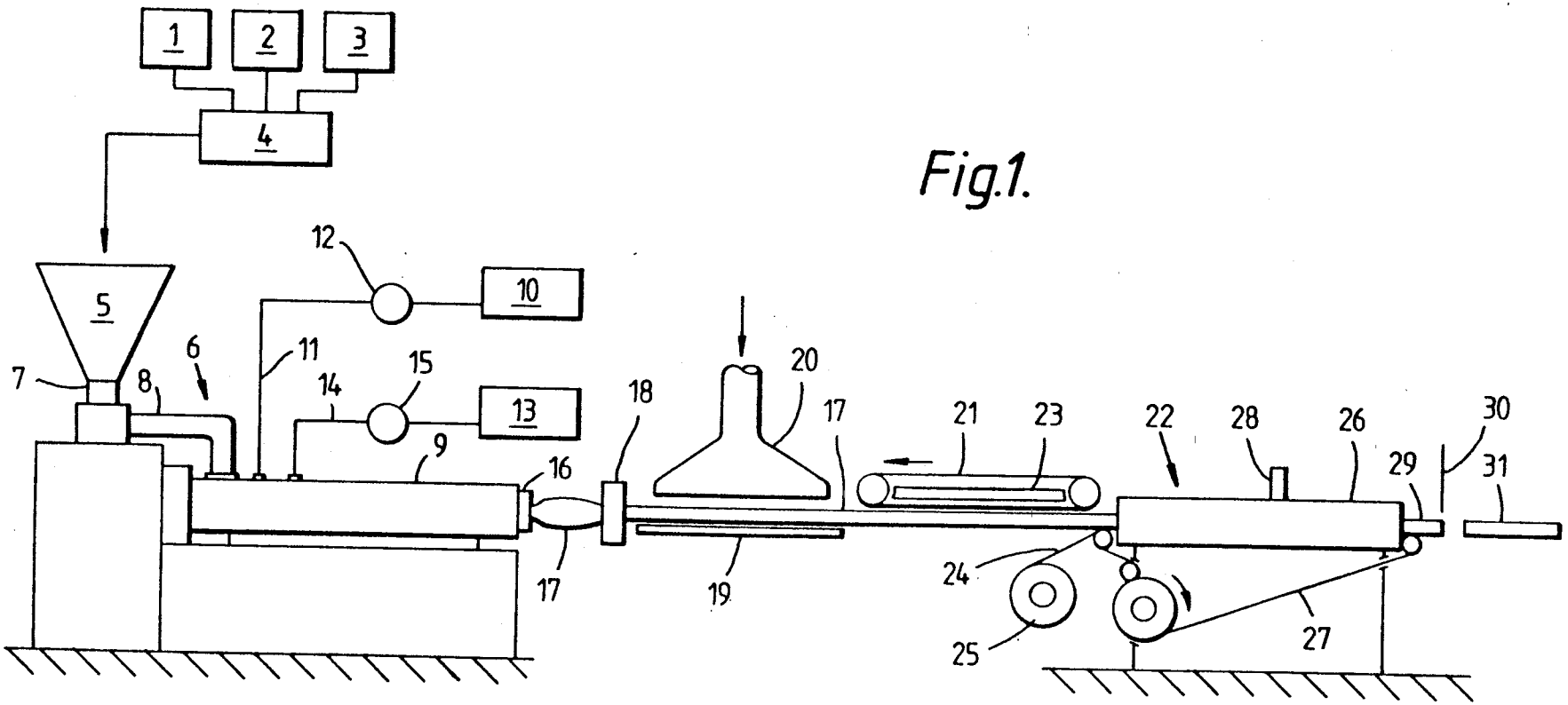
FIG. 1 shows apparatus for making smoking article rod.

In operation of the apparatus shown in FIG. 1 of the drawings to produce reconstituted tobacco smoking article rods, tobacco of fine particulate form, starch and cellulosic binder are fed respectively from bins 1, 2 and 3 to a mixer unit 4, wherein the components are mixed without the addition of water. The formulation by weight of the mixture may be, for example, 80% tobacco offal, 15% starch and 5% cellulosic binder. Factory offal may be readily used without any requirement for the offal to be ground. The cellulosic binder may, for example, be constituted by three parts by weight hydroxypropyl cellulose and two parts by weight sodium carboxymethyl cellulose.

After the components have been thoroughly mixed in the mixer unit 4, the mixture is fed to hopper 5 of a twin-screw extruder generally designated by reference numeral 6. A feed unit 7 of the extruder 6 serves to feed the mixture through a feed pipe 8 to the inlet end of barrel 9 of the extruder 6. Water drawn from a tank 10 is injected into the barrel 9 through a line 11 under the action of a pump 12. Similarly, glycerol is drawn from a tank 13 and injected into the barrel 9 through a line 14 under the action of a pump 15.

If an addition of sugar is to be included, the sugar is conveniently fed to the mixer unit 4 with the materials from bins 1–3.

The flow rate of mixture to the barrel 9 from the hopper 5 may be, for example, 86 kg per hour, in which case the flow rates of water and glycerol through the lines 11 and 14 are suitably 10 and 5 kg per hour respectively. The total water in the wet mix in the barrel 9 may, for example, represent 16% by weight of the wet mix.

The barrel 9 is provided with heating means (not depicted in the drawing) through the operation of which a desired temperature profile can be maintained along the barrel 9. The barrel temperature may, for example, be maintained at 40° C. at the inlet end increasing to 95° C. at the outlet end.

The pressure within the extruder must be maintained at a high enough value to ensure that water therein remains in the liquid phase. We have found that a pressure within a range of 500 psig (3400 kPa) to 2000 psig (13600 kPa) is suitable.

At these temperatures and pressures the starch fed to the extruder is caused to gelatinize.

At the outlet end of the barrel 9 of the extruder 6 there is mounted an extruder die 16, which die 16 is provided with an exit orifice of circular cross-section. As the extrudate, designated by reference numeral 17, issues from the die 16, water in the extrudate 17 flashes off to steam, as a result of which the cross-section of the extrudate 17 becomes greater than the cross-section of the exit orifice of the die 16 and there is imparted to the extrudate 17 a substantially closed cell interior structure. The temperature of the extrudate 17 when measured adjacent the die 16 has been found to be typically 115° C.

In addition to the extruder 6, the smoking article rod making apparatus comprises a vacuum sizing die 18, a support member 19, a head 20 of a cooling unit (not otherwise shown), a perforated, metal suction band 21 and a garniture unit generally designated by reference numeral 22.

During rod making operation of the apparatus, the suction band 21 is driven, by drive means not shown, such that the lower run thereof travels in a direction towards the garniture unit 22. In that a suction box 23 induces a sub-atmospheric pressure at the upper side of the lower run of the band 21, the extrudate 17 is caused to adhere to the under side of the lower run, the extrudate 17 thus being moved continuously forward by the band 21. In this way the suction band 21 serves to pull the extrudate 17 through the sizing die 18.

In the passage thereof between the die 18 and suction band 21, the extrudate 17 is supported on support member 19, which member 19 suitably comprises a low friction surface in contact with the extrudate 17. The support means 19 may also comprise a groove or other means serving to guide the extrudate 17.

By way of head 20, cooling air is directed at the extrudate 17, so that by the time that the extrudate 17 comes into contact with the suction band 21, the surface tackiness of the extrudate 17 is insufficient to cause the extrudate to stick to the band 21. Thus, although the extrudate adheres to the band 21 because of the subsistence of sub-atmospheric pressure above the lower run of the band 21, the extrudate 17 and band 21 separate cleanly at the downstream end of the lower run of the band 21.

Downstream of the suction band 21 the rod form extrudate 17 passes, together with a web 24 of cigarette paper wrapper from a bobbin 25, to the entry of a garniture 26 of the garniture unit 22. The extrudate 17 and web 24 are conveyed through the garniture unit 26 by an endless garniture tape 27 of the garniture unit 22, which tape 27 is driven, by drive means not shown. During the passage of the extrudate 17 and the web 24 of cigarette paper through the garniture 26, the web 24 is caused to be wrapped about the extrudate 17 and is then lap seamed, lap seam adhesive being applied to a margin of the web 24 from an applicator designated by reference numeral 28.

There issues from the outlet end of the garniture 26 a wrapped cigarette rod 29 of circular cross-section, which rod 29 is cut at intervals by a cutter blade, designated by reference numeral 30, to provide discrete smoking article rods, one of which is designated by reference numeral 31.

The drive means of the suction band 21 and of the garniture tape 27 are synchronised such that the linear conveying speed of the band 21 is the same as that of the tape 27.

As well as serving to pull the extrudate 17 through the sizing die 18, the suction band 21 serves to draw down the extrudate 17. The degree of drawing down to which the extrudate 17 is subjected must be sufficient to ensure that the internal cellular structure thereof is converted to a structure open enough for a discrete smoking article rod to exhibit an acceptable pressure drop.

By use of somewhat modified apparatus the extrudate 17 could be subjected to draw down upstream of the sizing die instead of, or in addition to being subjected to draw down downstream of the sizing die.

The cross-sectional area of the extrudate at entry to the garniture 26 is greater than that of the wrapped extrudate which issues as rod 29 from the outlet end of the garniture 26. That is to say, the garniture 26 subjects the extrudate to radial compression.

The discrete smoking article rods 31 may be transferred to a filter tip attaching machine (not shown) for the production of tipped smoking articles.

An alternative and preferred formulation for the mixture fed to the extruder 6 comprises 85% tobacco, 9% hydroxypropyl cellulose and 3.5% starch.

Figure 2:
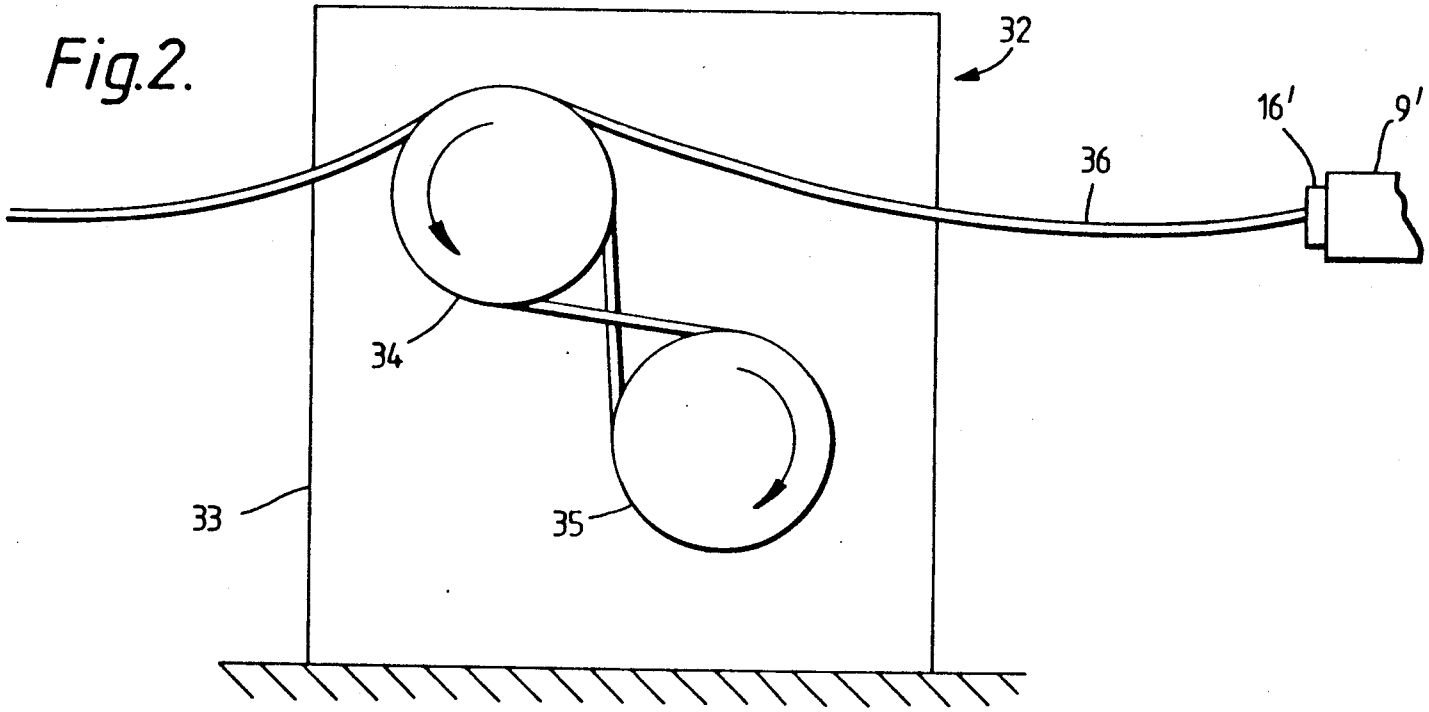
FIG. 2 shows a draw down unit.

In alternative and preferred apparatus the sizing die 18, the support member 19, the cooling unit of which head 20 forms a part, and the suction band 21 of the FIG. 1 apparatus are replaced by a draw down unit, which unit is shown in FIG. 2 and is generally designated by reference numeral 32.

The draw down unit 32 comprises a cabinet 33 in which are housed, but not shown in FIG. 2, drive means and water chilling and circulating means. Mounted from the cabinet 33 are first and second, spaced apart draw down drums 34 and 35. The drums 34 and 35, which are each of a diameter of, for example, 60 cm, are drivable, at a common peripheral speed and in directions shown by arrows, by the aforementioned drive means.

Figure 3:
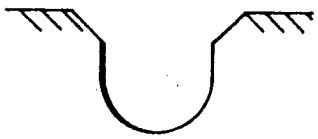
FIG. 3 shows, in transverse section, a groove of a draw down drum of the unit shown in FIG. 2.

Each of the drums 34, 35 is provided at the periphery thereof with a number of circumferential grooves. Thus, for example, drum 34 may suitably be provided with twelve such grooves, in which case drum 35 is provided with eleven such grooves. Advantageously, the grooves are generally of a transverse configuration as shown in FIG. 3.

The aforementioned water chilling and circulation means is operable to circulate chilled water within drums 34, 35 so as to effect a cooling of the surfaces of the circumferential grooves of the drums.

An extruder die 16', of an extruder as per that of FIG. 1, is, as seen in plan view, aligned with a first, endmost peripheral groove of the draw down drum 34. Similarly, a garniture unit (not shown) as per that of FIG. 1 is aligned with the endmost peripheral groove of drum 34 remote said first groove, the latter of which may be termed the final groove.

In operation of the alternative apparatus, rod form extrudate 36 which issues from die 16' is first trained about drum 34 within the first peripheral groove of drum 34. The extrudate 36 is then trained about drum 35 within a first, endmost peripheral groove thereof. From drum 35 the extrudate 36 passes back to drum 34, this time being located in the peripheral groove thereof next adjacent the first said groove of that drum. In this fashion the extrudate is trained alternately about the drums 34, 35.

The extrudate 36 passes from the said final peripheral groove of draw down drum 34 to the garniture unit, in which unit the extrudate 36 is wrapped in cigarette paper in the manner above described with reference to FIG. 1.

The peripheral speed of the drums 34, 35 is suitably within a range of 50 to 120 meters per minute.

The extrudate 36 is subjected to draw down in the passage thereof from the extruder die 16' to the draw down drum 34 and also between the drums 34 and 35. The major proportion of the draw down to which the extrudate is subjected occurs between die 16' and drum 34.

The extrudate 36 is subjected to draw down in its passage about drums 34, 35 because as the extrudate cools it contracts, the contraction being longitudinal as well as circumferential. In that circumferential contraction occurs, the first encountered grooves of the drums 34, 35 are suitably of a larger cross-section than later encountered grooves.

With reference to FIG. 3 it may be observed that the inner, semi-circular portion of the peripheral grooves of drums 34, 35 serves to shape the extrudate 36. In this respect it may be noted that one side of the extrudate 36 is contacted by the grooves of drum 34 and the reverse side is contacted by the grooves of drum 35.

From the above description it will be appreciated that the draw down unit 32 serves three purposes with respect to the extrudate, namely drawing down, cooling and shaping. The unit 32 accomplishes these purposes in a simple, effective and elegant manner.

It may be noted with regard to FIG. 2 that no support means for supporting the extrudate 36 are required between die 16' and drum 34 or between drum 34 and the garniture unit.

We claim:

1. A method of making a smoking article rod, wherein a mixture of particulate tobacco and binder, with the addition of water, is extruded through an exit orifice of an extruder die, to provide a rod form monolithic extrudate, under such extrusion conditions that said extrudate assumes a cross-section greater than that of the exit orifice of the extruder die, said extrudate in the plastic phase thereof is drawn down and has a cellular structure which is of an axially elongated conformation and lengths of said extrudate provide said smoking rod.

2. A method according to claim 1, wherein the drawn down extrudate is passed through a garniture unit operative to wrap said extrudate in a wrapper material.

3. A method according to claim 1 wherein said extrusion conditions are such that upon said extrudate issuing from said die, water in said extrudate flashes off to steam.

4. A method according to claim 1, wherein the draw down ratio is at least 1.5 to 1.

5. A method according to claim 1, wherein said mixture includes starch.

6. A method according to claim 1, wherein the draw down of said extrudate is effected by passing said extrudate about a rotating draw down drum.

7. A method according to claim 6, wherein said extrudate is passed about a further drum.

8. A method according to claim 7, wherein each of the two drums comprises a plurality of peripheral, extrudate-locating grooves.

9. A smoking article provided by a method according to claim 1.

10. A method of making a smoking article rod, wherein a mixture of particulate tobacco and binder, with the addition of water, is extruded through an exit orifice of an extruder die, to provide a rod form extrudate, under such extrusion conditions that said extrudate assumes a cross-section greater than that of the exit orifice of the extruder die, said extrudate in the plastic phase thereof is drawn down by passing said extrudate about a rotating draw down drum and a further drum wherein each of the two drums comprises a plurality of peripheral, extrudate located grooves.

* * * * *